US005551100A

United States Patent [19]

Kindrick

[11] Patent Number: 5,551,100

[45] Date of Patent: Sep. 3, 1996

[54] BATH BENCH

[76] Inventor: Ronald S. Kindrick, 10990 West Rd. #615, Houston, Tex. 77064

[21] Appl. No.: 310,914

[22] Filed: Sep. 22, 1994

[51] Int. Cl.[6] ..... A47K 3/022

[52] U.S. Cl. ..... 4/578.1

[58] Field of Search ..... 4/578.1, 579, 236, 4/240

[56] References Cited

U.S. PATENT DOCUMENTS

| | | | |
|---|---|---|---|
| D. 278,580 | 4/1985 | Collins | D6/349 |
| 1,923,482 | 8/1933 | Frankenstein | 4/578.1 X |
| 2,899,688 | 8/1959 | Hopkins | 4/579 |
| 3,570,019 | 3/1971 | Osborne | 4/185 |
| 3,579,668 | 5/1971 | Aronovitz | 4/578.1 |
| 3,873,151 | 3/1975 | Morris et al. | 297/14 |
| 4,087,127 | 5/1978 | Lotta | 297/14 |
| 4,955,093 | 7/1988 | Klassen | 4/579 |
| 5,185,892 | 2/1993 | Mitchell | 4/578 |

FOREIGN PATENT DOCUMENTS

| | | | |
|---|---|---|---|
| 2522263 | 9/1983 | France | 4/240 |

*Primary Examiner*—Charles E. Phillips
*Attorney, Agent, or Firm*—John R. Casperson

[57] ABSTRACT

A convenient bathtub and shower seat, adapted for wall surface mounting within a bathtub with shower stall environment, includes a panel member which is pivotally connected to the shower stall wall for up and down pivotal movement between a vertical storage position and a horizontal use position with downward pivotal movement being limited by the bathtub rear and side walls. Hinge members affixed to the stall wall surface provide the connection for panel member pivotal movement and removal of panel member for cleaning and disinfecting. Storage catch member affixed to the stall wall provides for securing the panel member in the vertical storage position.

24 Claims, 5 Drawing Sheets

BATH BENCH

BACKGROUND OF THE INVENTION

In one aspect, the present invention is directed to a convenient seating unit adapted to support a person in a sitting position while in a bathtub with shower stall environment. In another aspect, the invention relates to certain components suitable for use in such a unit.

Whereas bathing or showering is a daily routine for most individuals, cleansing or grooming of the lower body and lower extremities can be difficult, uncomfortable or hazardous. Additionally, elderly persons or individuals with health concerns that limit mobility or activities often find bathing a tedious and tiring chore. The common solution for most individuals has been to place a chair or stool within the bathtub. Conventional stools or chairs often run the risk of sliding or tipping over and lack convenience of storage when not in use.

Wall mounted seats for a bathtub with shower stall environment have been previously proposed. However, cost, design, materials and mounting means have made these seating units expensive, unattractive or inaccessible to most individuals. Most seating units are manufactured with materials that are not long term resistant to a damp or wet environment and the combination of design and materials do not provide ease in cleaning or disinfecting. Some seating units must be built into the stall wall during construction or require reconstruction for installation while other seating units, using conventional mounting methods, require structural support from existing walls and cause permanent damage to wall surfaces.

A seating unit which is functional yet easy to install, clean and store would be very desirable.

OBJECTS OF THE INVENTION

Accordingly, a principal object of the present invention is to provide an improved wall mounted seat for a bathtub with shower stall environment.

Another object is to provide an improved seat for a bathtub with shower stall environment, that is simple in design, easy to install, easy to use, rugged in construction, economical to manufacture and efficient in operation.

Another object is to provide an improved seat, for a bathtub with shower stall environment, that provides secure structural support of the seat member which is safe and unable to slide or tip over.

Another object is to provide an improved seat, for a bathtub with shower stall environment, that mounts easily, safely and securely without doing permanent damage to existing walls.

Another object is to provide an improved seat, for a bathtub with shower stall environment, that pivots easily from a compact storage position to a usage position or from a usage position to a compact storage position.

Another object is to provide an improved seat, for a bathtub with shower stall environment, that utilizes materials which are resistant to and wear well in a damp or wet environment.

Another object is to provide an improved seat, for a bathtub with shower stall environment, that is removable and provides ease in cleaning and disinfecting of the entire seating unit, stall walls and bathtub.

SUMMARY OF THE INVENTION

In one embodiment of the invention, there is provided a seating unit for a bathtub. The invention is best used with a bathtub having a rear splash wall, such as a bath-shower combination unit. The bathtub can be characterized as having a first side wall, a second side wall, and a back end wall. The back end wall connects the first side wall with the second side wall. Each of the walls has an upper end. The rear splash wall extends upwardly from the upper end of the back end wall of the bathtub. The seating unit comprises a panel member and a means for pivotally connecting the panel member to the rear splash wall. The panel member has a length sufficient to simultaneously contact the upper end of the first side wall and the upper end of the second side wall. The means for pivotally connecting the panel member to the rear splash wall is positioned to connect the panel member to the rear splash wall at a location closely adjacent to the upper end of the back end wall so that the panel member will pivot from a storage position to a use position. Downward travel of the panel member is limited by the upper ends of the bathtub back end wall and side walls with said walls providing strong structural support when the panel member in the use position. In the stored position, the panel member is conveniently stored out of the way closely adjacent to the rear splash wall.

In a further embodiment of the invention, there is provided a panel member suitable for forming a bathtub seat. The panel member has a first end and a second end. A first generally planar face, an opposite second generally planar face, a first side surface and an opposite second side surface extending between the first end and the second end. A first hinge pin notch and a second hinge pin notch are defined by the first side surface. A first hinge pin portion is positioned across the first hinge pin notch. A second hinge pin portion is positioned across the second hinge pin notch. Each hinge pin portion has a first generally cylindrical face facing in the same direction as the first side surface of the panel member and a second generally cylindrical face facing away from the first generally cylindrical face. Each hinge pin portion also has a first generally planar face facing in the same direction as the first generally planar face of the panel member and a second generally planar face facing away from the first generally planar face. The hinge pin portions are recessed and positioned within the notches so that the panel member, while in the storage position or while pivoting between the storage position or use position, is supported by the first side surface of the panel member and while in a use position the panel member is supported by the panel member's second generally planar surface. This relieves the hinge pins and hinge members from stress or weight loading. This permits the hinge members to be adhesively fastened to the rear splash wall. The panel member is especially well suited for use in a bathtub environment.

In another embodiment of the invention, there is provided a hinge member which can be used to mount a panel member as described above to a rear splash wall. The hinge member is characterized by a hinge pin housing portion. The hinge pin housing portion has a first end surface, an oppositely facing second end surface, a first side surface, and an oppositely facing second side surface. A hinge pin receiving borehole extends across the width of the hinge pin housing portion from the first side surface to the second side surface. The hinge pin receiving borehole has a first diameter. The first end surface of the hinge pin housing portion defines a hinge pin receiving slot leading to the hinge pin receiving borehole. A hinge pin receiving slot extends across the width of the hinge pin housing portion from the first side surface to the second side surface of the hinge pin housing portion. The hinge pin receiving slot in conjunction with the hinge pin portion permits the panel member to be locked into the hinge member except when the panel member is placed in the unlock position. The hinge member is especially well suited for mounting a panel member in a bathtub with shower stall environment.

In another embodiment of the invention, there is provided a storage catch member which can be used to releaseably retain a panel member in a storage position as described above. The storage catch member has an arm portion with a lower surface which conforms to the panel member second side surface and extends at least partially across the second side surface of the panel member when in the storage position. The storage catch member is adhesively attached to the rear splash wall just above the panel member in the storage position.

DETAILED DESCRIPTION OF THE PREFERRED EMBODIMENTS

Figure 3:
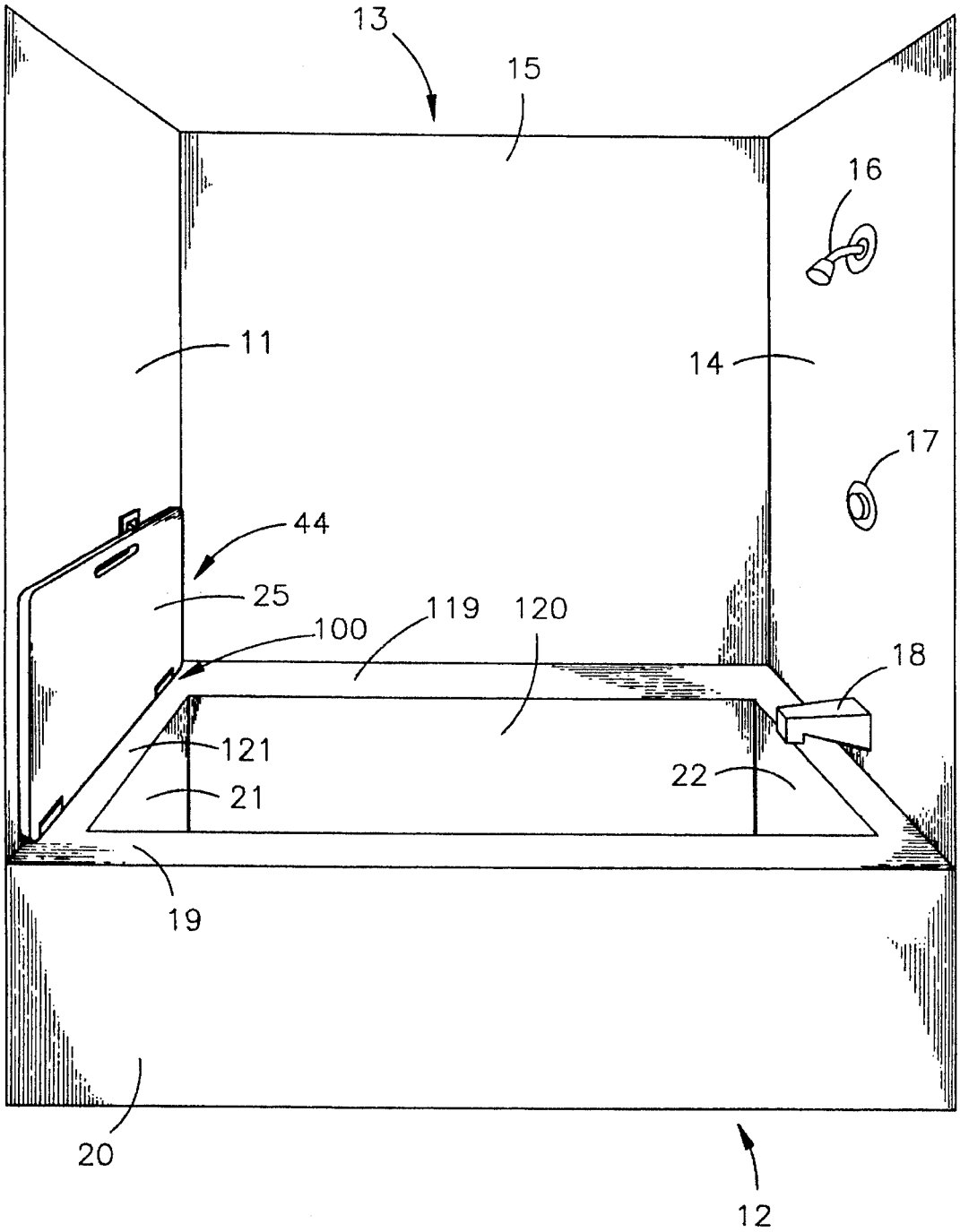
FIG. 3 is a perspective view of the bathtub and shower seat according to one embodiment of the invention, installed in a bathtub with shower stall environment, in the storage position.

In accordance with certain aspects of the invention, there is provided a seating unit 10 for a bathtub 12. The invention is best used with a bathtub 12 as illustrated in FIG. 3 having a rear splash wall 11, such as a bath-shower combination unit 13. The bathtub 12 can be characterized as having a first side wall 20, a second side wall 120, and a back end wall 21 connecting the first side wall with the second side wall. Each of the walls has an upper end 19, 119 and 121 respectively. The rear splash wall 11 extends upwardly from the upper end 121 of the back end wall 21 of the bathtub.

The seating unit 10 comprises a panel member 23 and a means 100 for pivotally connecting the panel member 23 to the rear splash wall 11. The means for pivotally connecting the panel member to the rear splash wall preferably comprises at least one hinge member 29. In a preferred embodiment, the seating unit is also provided with a storage catch member 30 attached to the rear splash wall 11 for retaining the unit in the stored position.

Figure 1:
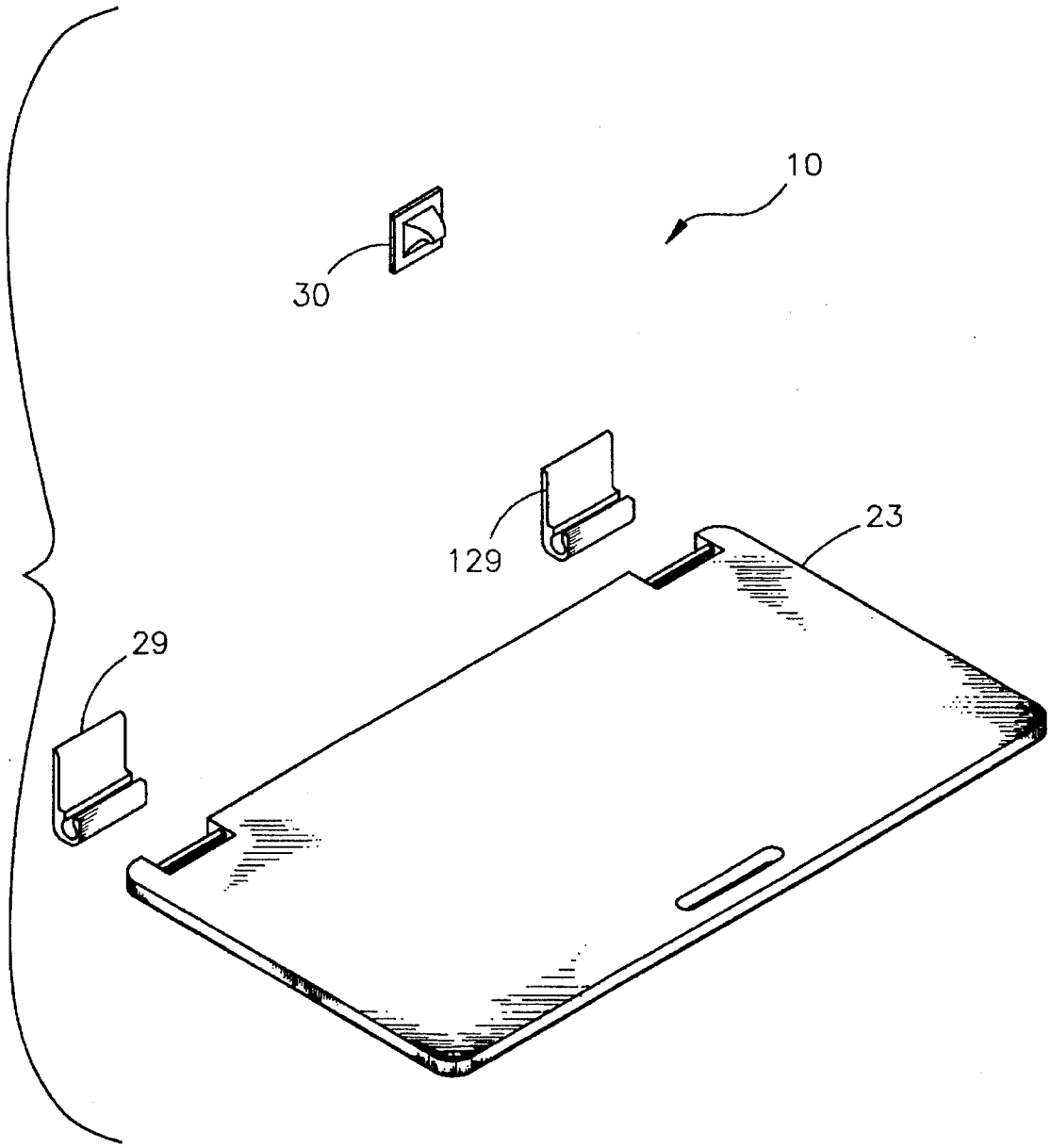
FIG. 1 is an exploded view of the bathtub and shower seat assembly according to one embodiment of the present invention which includes a panel member, the hinge members and the storage catch member.
Figure 2:
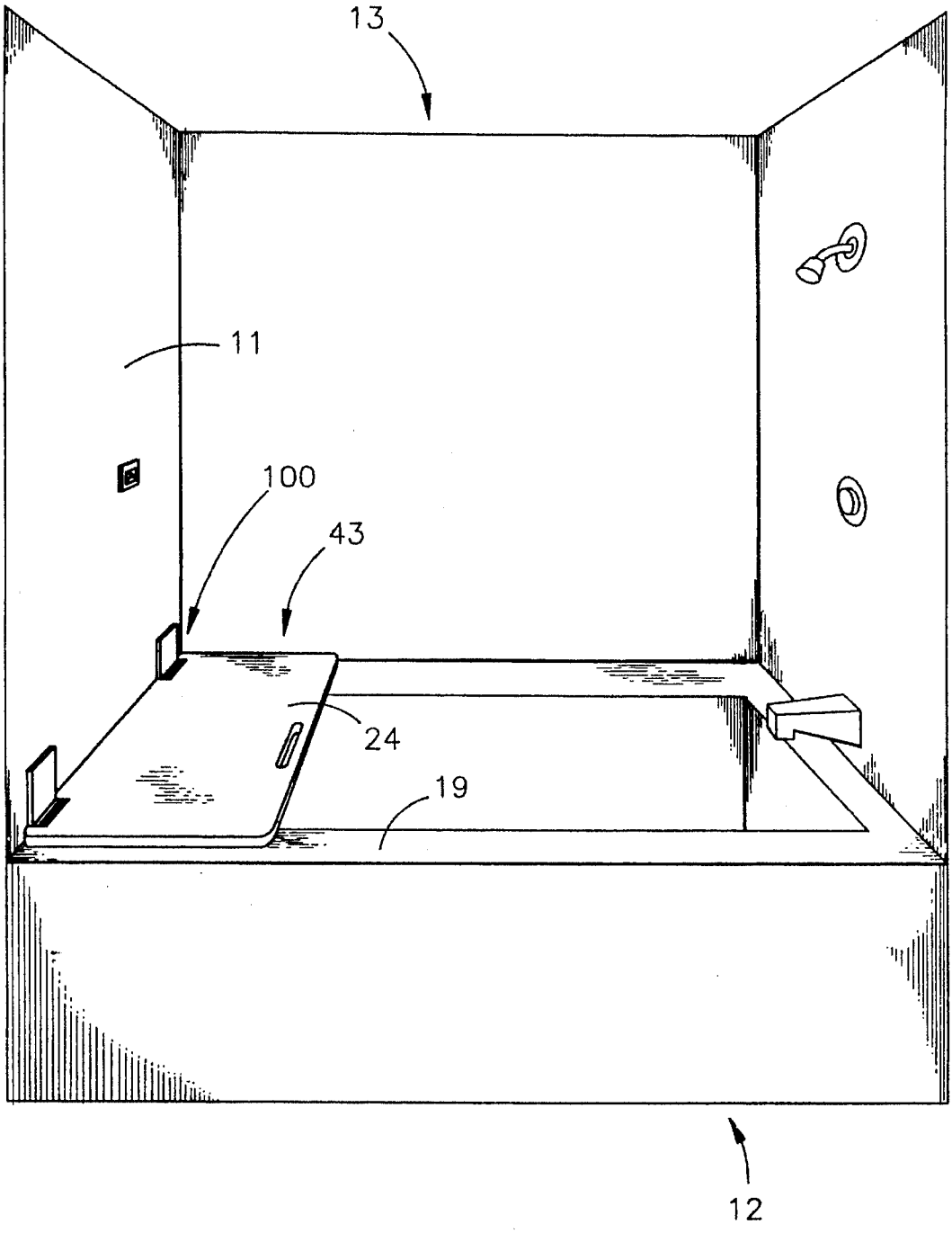
FIG. 2 is a perspective view of the bathtub and shower seat according to one embodiment of the invention, installed in a bathtub with shower stall environment, in the use position.

The bathtub and shower seat assembly 10 of the present invention as illustrated in FIG. 1 includes a panel member 23, hinge member 29 and 129, storage catch member 30 and is further illustrated in FIG. 2 installed onto the rear upright wall surface 11 of a bathtub 12 with shower stall 13. The horizontal usage position 43 of the bathtub and shower seat is illustrated in FIG. 2 and the vertical storage position 44 of the bathtub and shower seat is illustrated in FIG. 3.

Bathtub 12 illustrated in FIGS. 2 & 3 includes a front wall 22, a first side wall 20, a second side wall 120, and a back end wall 21. Shower stall 13 includes a front stall wall 14, rear stall wall 11, side stall wall 15, shower head 16, hot and cold water control 17, and faucet 18.

Figure 4:
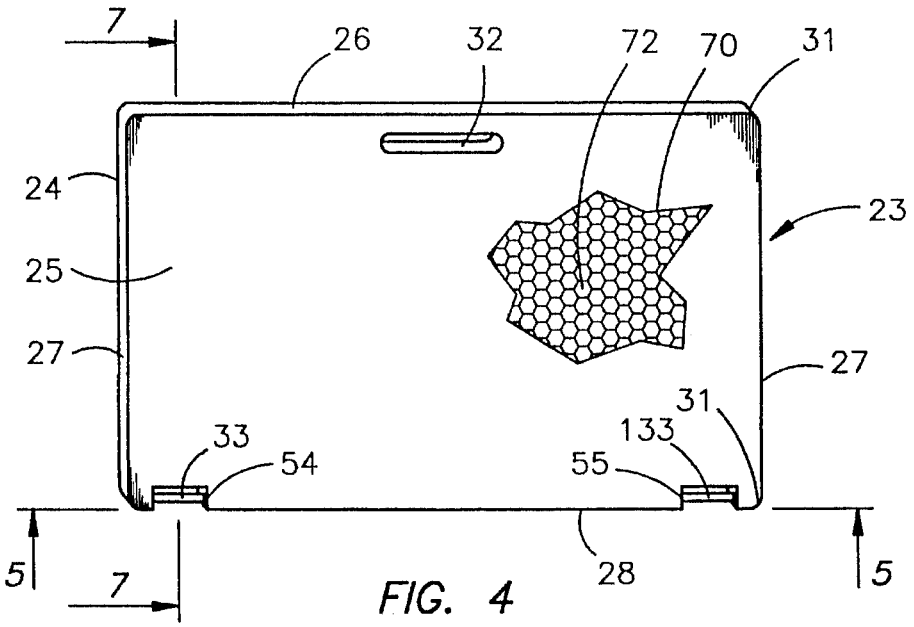
FIG. 4 is a perspective view of the panel member according to an embodiment of the invention, in the storage position, showing the relationship of the handle and hinge pins.
Figure 5:
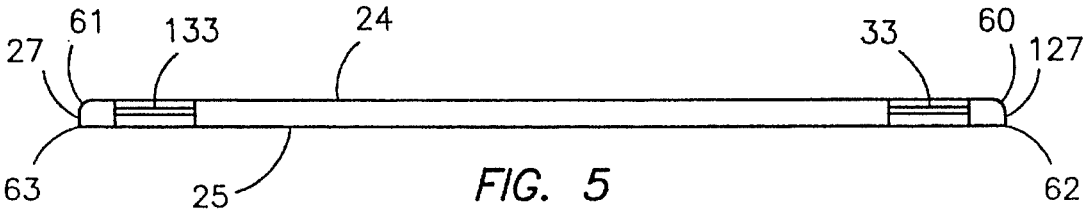
FIG. 5 is a rear perspective view of the panel member taken along lines 5—5 of FIG. 4, showing the design of the end surfaces and the relationship of the hinge pins.
Figure 6:
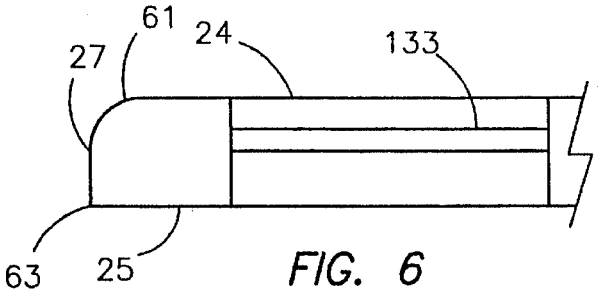
FIG. 6 is a closeup view of the design of the end surface and the relationship of the hinge pin as shown in FIG. 5.
Figure 8:
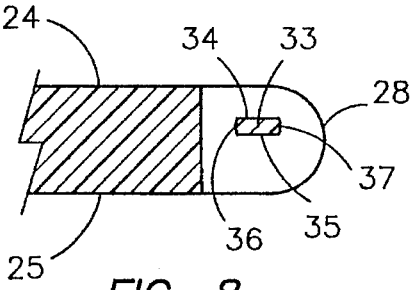
FIG. 8 is a closeup view of the device as shown in FIG. 7 showing the relationship of the hinge pin.

The panel member 23 is generally suitable for forming a bathtub seat. The panel member 23 as illustrated in FIGS. 4 and 5 has a first end 27 and a second end 127. A fist generally planar face 24, an opposite second generally planar face 25, a first side surface 28 and an opposite second side surface 26 extending between the first end 27 and the second end 127. A first hinge pin notch 54 and a second hinge pin notch 55 are defined by the first side surface 28. A first hinge pin portion 33 is positioned across the first hinge pin notch 54. A second hinge pin portion 133 is positioned across the second hinge pin notch 55. Each hinge pin portion has a surface forming a first generally cylindrical face 37 as illustrated in FIG. 8 which faces in the same direction as the first side surface 28 of the panel member 23 and a second generally cylindrical face 36 facing in the opposite direction from the first generally cylindrical face 37. Each hinge pin portion also has a first generally planar face 34 which faces in the same direction as the first generally planar face 24 of the panel member 23 and a second generally planar face 35 facing in the opposite direction from the first generally planar face 24.

The panel member 23 as illustrated in FIG. 4 preferably has a first end surface 27 positioned at the first end and a second end surface 127 positioned at the second end. The panel member 23 preferably has a generally rectangular configuration with generally rounded corners 31 connecting the end surfaces with the side surfaces. The panel member 23 has a length as measured between the first end surface 27 and the second end surface 127, a width as measured between the first side surface 28 and the second side surface 26, and a thickness as measured from the first generally planar face 24 to the second generally planar face 25. The length of the panel member is greater than the width and the width is greater than the thickness. The first hinge pin portion 33 and the second hinge pin portion 133 are positioned parallel to the length of the panel member.

The first hinge pin portion 33 and the second hinge pin portion 133 preferably are recessed into their respective hinge pin notches so that they will be positioned between the first generally planar face 24 and the second generally planar face 25, and between the first side surface 28 and the second side surface 26 of the panel member 23. By recessing the hinge pin portion 33 within hinge pin notch 54 and recessing hinge pin portion 133 within hinge pin notch 55, it is possible to use the first side surface 28 and the second generally planar surface 25 of the panel member 23 to support the weight of the panel member 23 and remove stress or weight from the hinge pin portions and hinge members. Recessing the hinge pin portions puts the weight on the second generally planar face 25 of the panel member 23 when in the use position 43 and places the weight on the first side surface 28 of the panel member 23 while in the storage position 44 or while pivoting between the use position and the storage position.

Figure 7:
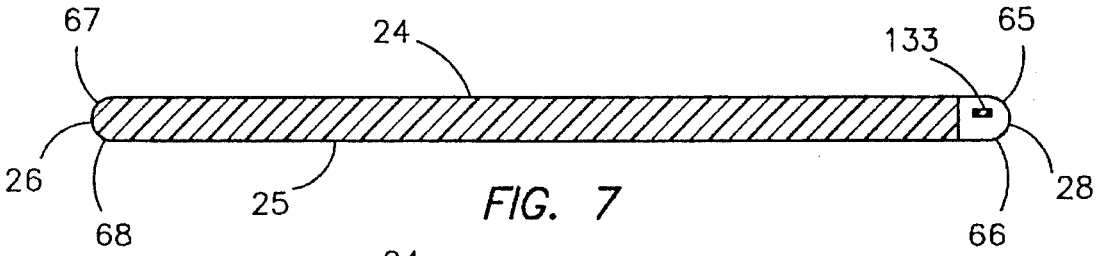
FIG. 7 is a cross sectional view of the panel member taken along lines 7—7 of FIG. 4 showing the relationship of the hinge pin.

The panel member 23 also preferably defines an elongated slot 32 extending from the first generally planar face 24 to the second generally planar face 25. The elongated slot is positioned adjacent to the second side surface 26 and is elongated in the direction of the length of the panel member 23 so that it can be used as a handle. The elongated slot is preferably centrally located between the first end surface 27 and the second end surface 127. The slot forms a handle which serves as a holding place during removal of panel member for cleaning or disinfecting. The slot which serves as the handle has rounded edges and a smooth finish for comfort. It is also preferred that a generally rounded edge 60 as illustrated in FIG. 5 connects the first generally planar face 24 with the first end surface 27, and a generally rounded edge 61 connects the first generally planar face with the second end surface 127. It is further preferred that a generally square edge 62 connects the panel member 23 second generally planar face 25 with the first end surface 27 and a generally square edge 63 connects the second generally planar face 25 with the second end surface 127. This generally square edge maximizes available surface area for contact between the panel member and the upper ends of the bathtub walls when the panel member 23 is in the use position 43. It is still further preferred that a generally rounded edge 65 as illustrated in FIG. 7 connects the panel member 23 first generally planar face 24 with the first side surface 28 and a generally rounded edge 66 connects the second generally planar face 25 with the first side surface 28. This generally rounded edge 66 of the first side surface 28 provides freedom of rotation with respect to and between the panel member 23 and the upper end 121 of the back end wall 21 of the bathtub 12 while providing aesthetic conformity with the hinge members. It is also preferred that a generally rounded edge 67 connects the panel member 23 first generally planar face 24 with the second side surface 26 and a generally rounded edge 68 connects the second generally planar face 25 with the second side surface 26. These generally rounded edges eliminate any sharp edges which could cause discomfort to a user of the device and better conform the second side surface 26 of the panel member 23 for receipt by the storage catch 30.

The panel member can be formed from a wide variety of materials. It is preferred that the panel member be formed partially from plastic, because this permits the hinge pin portions, end surfaces and side surfaces to be injection molded and facilitates providing the first generally planar face 24 and the second generally planar face 25 with a skid resistant surface. A skid resistant or textured non skid upper surface preferably reduces or eliminates slippage or sliding of the user while sitting on the panel member. A textured non skid bottom surface acting in combination with the weight of the user will eliminate slippage or sliding of the panel member when the device is used. Plastic is rugged and sanitary and will endure for a great length of time with little or no care while injection molding of plastic eliminates fabrication or machining requirements and allows for a design which reduces weight and material usage. To reduce weight and expense, the panel member can be formed from a polymer shell 70 encasing a lightweight core material, for example, a core material 72 having a honeycomb configuration or a solid core material, such as foam, which could be injected into the shell. The hinge pin portion can also be formed from plastic, either integral with the panel member or as a separate piece which can be snap fitted or threadably fitted into position.

Figure 10:
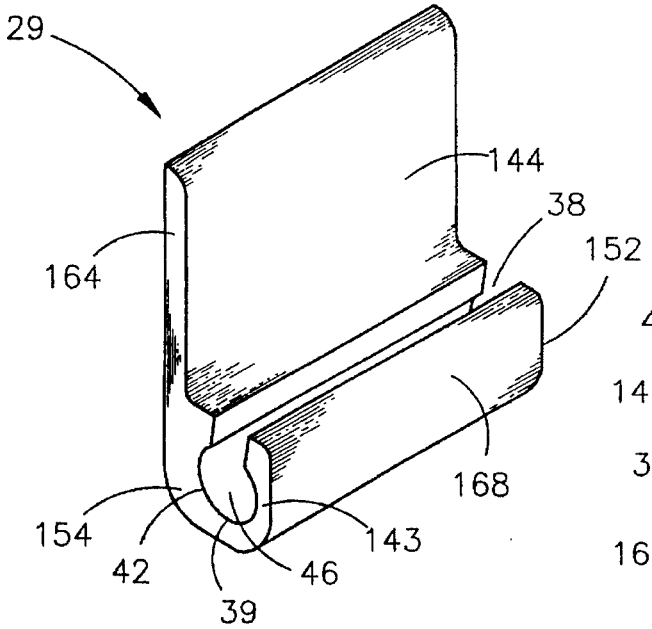
FIG. 10 is a perspective view of the hinge member.
Figure 9:
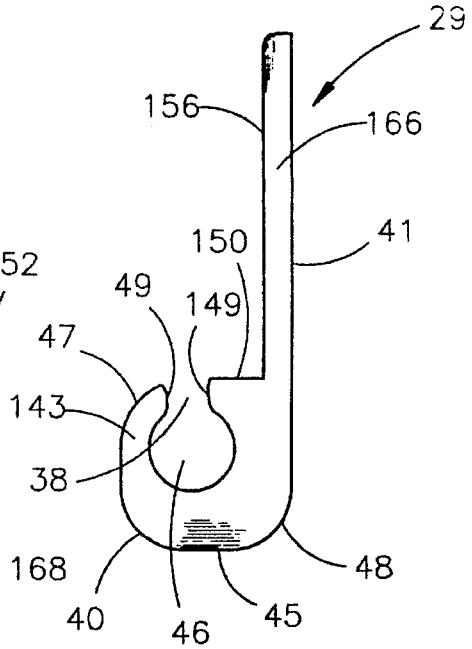
FIG. 9 is a side elevation view of the hinge member according to one embodiment of the invention.
Figure 11:
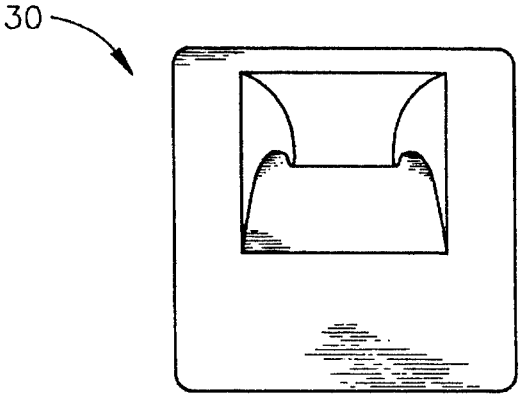
FIG. 11 is a front elevation view of one embodiment of the storage catch member.
Figure 12:
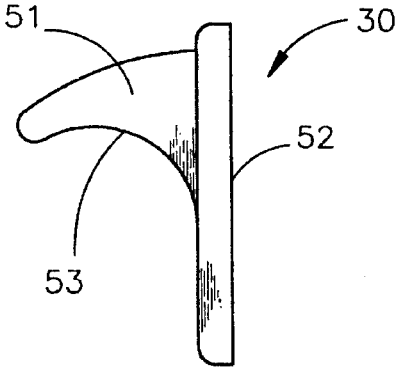
FIG. 12 is a side elevation view of the storage catch member.
Figure 13:
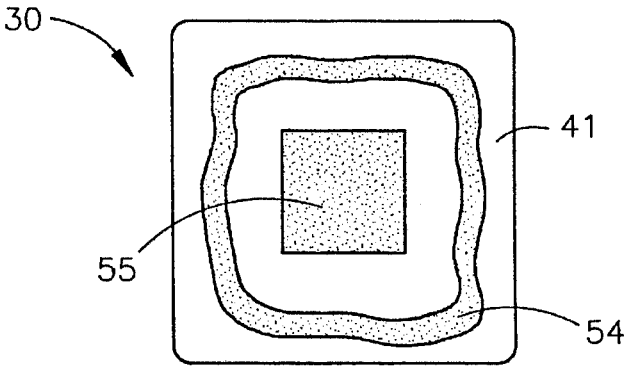
FIG. 13 is a rear elevation view of either the hinge or storage catch member with an adhesive system.

The hinge member 29 as illustrated in FIGS. 9 and 10 is characterized by a hinge pin housing portion 143. The hinge pin housing portion 143 has a first end surface 150, an oppositely facing second end surface 45, a first side surface 152, and an oppositely facing second side surface 154. A hinge pin receiving borehole 46 extends across the width of the hinge pin housing portion 143 from the first side surface 152 to the second side surface 154. The hinge pin receiving borehole 46 has a first diameter. The first end surface 150 of the hinge pin housing portion defines a hinge pin receiving slot 38 leading to the hinge pin receiving borehole 46. The hinge pin receiving slot 38 extends across the width of the hinge pin housing portion 143 from the first side surface 152 to the second side surface 154.

Preferably, the hinge member 29 has a hinge member plate portion 144. The hinge member plate portion 144 has a first generally planar face 156 and a second generally planar face 41 opposite from the first generally planar face 156. The hinge member plate portion extends from the first end surface 150 of the hinge pin housing portion 143. The second generally planar face 41 of the hinge member plate portion and a generally planar face of the hinge pin housing portion together define a generally planar face 41 for mounting the hinge member to the rear splash wall 11. The hinge member plate portion has a first side surface 164 and a second side surface 166 and a width as measured between the first side surface 164 and the second side surface 166. The hinge pin housing portion 143 protrudes from the first face 156 of the hinge member plate portion and extends at least partially across the width of the hinge member plate portion. The hinge member plate portion and the hinge member pin housing portion together define a generally J shaped structure as best shown in FIG. 9. Preferably, the hinge pin housing portion 143 protrudes a sufficient distance to accommodate the hinge pin receiving borehole 46 which is a larger circumference than the hinge pin diameter to allow free rotation of hinge pins 33 and 133.

The hinge pin receiving slot 38 has a width as measured at a right angle to the width of the hinge member plate portion which is less than the diameter of the hinge pin receiving borehole. Preferably, the hinge pin receiving slot is oriented generally radially with respect to the hinge pin receiving borehole 46. More preferably, the hinge pin receiving slot 38 is oriented at an angle in the range of from about 3 degrees to about 30 degrees with respect to the second generally planar face 41 of the hinge member, even more preferably at an angle in the range of from about 5 degrees to about 10 degrees with respect to the generally planar face 41 of the hinge member. The hinge pin receiving borehole surface 39 is preferably spaced apart from a plane defined by the first generally planar face 156 of the hinge member plate portion as well as from the second end surface 45, the first end surface 150, and the front surface 168 of the hinge member 29.

In a particularly preferred embodiment, the hinge pin receiving slot 38 is defined by an outer receiving slot surface 149 and an inner receiving slot surface 49. The hinge pin receiving borehole is defined by a hinge pin receiving borehole surface 39. It is preferred that the inner and outer ends of the hinge pin receiving slot be tapered to facilitate insertion and removal of the hinge pin members 33 and 133 which are part of the panel member 23. In a preferred embodiment, a generally rounded edge connects the first end surface 150 of the hinge pin housing portion with the outer receiving slot surface 149 and a generally rounded edge connects the hinge pin receiving borehole surface 39 with the outer receiving slot surface 149. A generally rounded edge also connects the first end surface 150 of the hinge pin housing portion with the inner receiving slot surface 49 and a generally rounded edge connects the hinge pin receiving borehole surface 39 with the inner receiving slot surface 49. A generally rounded edge 47 also connects a front surface 168 of the hinge pin housing portion 143 with the first end surface 150 to provide freedom of rotation for the panel member 23. A generally rounded edge 40 preferably connects the second end surface 45 with the front surface 168 for aesthetics. A rounded edge 48 connects the second end surface 45 with the generally planar surface 41 to accommodate caulking between bathtub and tile. An imaginary longitudinal axis of the hinge pin receiving borehole 46 is generally parallel to the hinge member second end surface 45 and the second generally planar face 41 of the hinge member so that the hinge pin receiving borehole will be properly positioned with respect to the upper end 121 of the back end wall 21 and the splash wall 11.

In another embodiment of the invention, there is provided a seating unit 10 for a bathtub 12. The seating unit 10 comprises a panel member 23 which can be as described above and a means 100 for pivotally connecting the panel member 23 to the rear splash wall 11. The panel member 23 has a length sufficient to simultaneously contact the upper end 19 of the first side wall 20 and the upper end 119 of the second side wall 120. The means 100 pivotally connects the panel member 23 to the rear splash wall 11 at a location adjacent to the upper end 121 of the back end wall 21, so that the panel member 23 will pivot from a storage position 44 as illustrated in FIG. 3 to a use position 43 as illustrated in FIG. 2.

Preferably, the panel member 23 is adjacent to the rear splash wall 11 when in the storage position 44. When the panel member 23 is in the use position 43, a first end portion of the second generally planar face 25 of the panel member 23 contacts the upper end 19 of the first side wall 20 and a second end portion of the second generally planar face of the panel member 23 contacts the upper end 119 of the second side wall 120. Even more preferably, a first side portion of the second generally planar face 25 of the panel member 23 contacts the upper end 121 of the back end wall 21. Providing the panel member 23 with generally square edges 62 and 63 increases the available contact area between the panel member 23 and the bathtub. The panel member 23 first side surface 28 preferably contacts the upper end 121 of the back end wall 21 when the panel member is in the storage position 44. This contact takes stress or weight off of the hinge members and hinge pin portions. The hinge pin portions are preferably positioned for only incidental contact with the hinge pin receiving borehole surfaces of the hinge members. By providing the panel member 23 with the generally rounded edge 66, smooth movement between the storage position and the use position is facilitated as well as the avoidance of unnecessary stress on the means 100 for pivotally connecting the panel member 23 to the splash wall 11.

The storage catch member 30 is preferably affixed to the rear splash wall 11 to releaseably retain the panel member 23 while in the storage position 44. Preferably, the storage catch member 30 releaseably engages the second side surface 26 of the panel member 23. The storage catch member 30 preferably has an arm portion 51 and a storage catch plate portion 52 and is affixed to the rear splash wall 11 by the storage catch plate portion 52. The storage catch arm portion 51 extends away from the storage catch plate portion 52 and has a generally concave lower surface 53 to receive the second side surface 26 of the panel member 23. It is preferred that the second side surface 26 of the panel member 23 has a generally convex shape with a first radius and the generally concave lower surface 53 of the storage catch arm portion 51 of the storage catch member has a second radius which is larger than the first radius to facilitate the storage catch member performing a latching function. It is further preferred that at least the storage catch arm portion of the storage catch member is formed from a resilient material so that the storage catch arm portion 51 is movable from a storage position to a sue position as the panel member 23 moves into and out of the storage position 44 to further assure that the storage catch member 30 will provide a latching function. Plastic is a preferred material of construction for the storage catch member 30.

Preferably, the panel member 23 is secured to the rear splash wall 11 by a first hinge member 29 and a second hinge member 129. The panel member 23 is removable from the first hinge member 29 and the second hinge member 129 when the panel member 23 is oriented in a panel unlock position. The panel unlock position is at a location between the storage position 44 and the use position 43 and coincides with the orientation of the hinge pin receiving slot 38. In the panel unlock position, the generally planar faces 34 and 35 on the hinge pin portions 33 and 133 are aligned with the hinge pin receiving slot 38 in the hinge members 29 and 129 to permit passage through the hinge receiving slot 38. Except when in the panel unlock position, the hinge pin portions will not pass through the slot. Desirably, the first hinge pin portion 33 fits loosely in the hinge pin receiving borehole of the first hinge member 29 and the second hinge pin portion 133 fits loosely in the hinge pin receiving borehole of the second hinge member 129 so that the second side surface 28 of the panel member 23 rests against the upper end 121 of the back end wall 21 of the bathtub when the panel member 23 is in the storage position 44. The hinge pins 33 and 133 primarily serve as a guide while the panel member pivots from either the usage or storage position and additionally function as a key, during removal or replacement of the panel member, for entry to and exit from the hinge members. The hinge pin is specifically designed to be non weight bearing. Desirably, the hinge pin portions fit loosely in the hinge pin receiving boreholes of the hinge members to that the weight of the panel members can be removed from the hinges.

When the panel member 23 is in the use position 43, the hinge pin axis is set apart from the second generally planar surface 25 of the panel member 23 further than the distance from the hinge member second end surface 45 to the closest surface 39 of the hinge pin receiving borehole 46 and is set apart from the first side surface 28 of the panel member 23 further than the distance from the hinge member mounting plate portion first generally planar face 156 to the closest surface 39 of the hinge pin receiving borehole 46.

When the panel member 23 is in the storage position 44, the hinge pin axis is set apart from the first generally planar surface 24 of the panel member 23 further than the distance from the hinge member mounting plate portion first generally planar face 156 to the closest surface 39 of the hinge pin receiving borehole 46 and is set apart form the panel member 23 first side surface 28 further than the distance from the hinge member second end surface 45 to the closest surface 39 of the hinge pin receiving borehole 46.

This configuration permits the weight of the panel member 23 to be supported by the upper ends of the bathtub walls. In an embodiment of the invention which has been tested with good results, the hinge portions were formed from 5/16 inch stock and the hinge pin receiving borehole had a diameter of 3/8 inch. The hinge pin receiving slot had a width between the inner slot surface 149 and the out slot surface 149 of about 1/4 and the hinge pin portions measured about 7/32 inch from the generally planar face to the generally planar face.

The hinge member 29, the second hinge member 129, and the storage catch member 30 can be affixed to the rear splash wall 11 by a wide variety of techniques. Preferably, they are adhesively affixed to the rear splash wall. It is particularly preferred to utilize double sided tape 55 centrally located in the respective plate portion of the catch member and the hinge members. Even more preferably, the plate portions are further secured by a bead 54 of an adhesive material. Preferably, a solvent-based adhesive material is used. Even more preferably, the adhesive material comprises an adhesive-sealant material because such material fills the gaps and prevents moisture from penetrating between the hinge and storage catch members and the splash wall. Goop brand adhesive sealant has been tested with good results.

Whereas the bathtub and shower seat of the invention has been shown and described in connection with the preferred embodiments thereof, it is understood that many modifications, substitutions and additions may be made which are with in the intended broad scope of the appended claims. For example whereas the hinge members and storage catch are mounted to the wall surface with adhesive, they could be mounted to wall surface with screws or bolts. Whereas the panel member hinges to the rear and stores against the rear wall it could hinge to the side and store against the side wall. Whereas injection molded plastic is the preferred material and manufacturing method, plastic, wood, aluminum, steel or other suitable materials could be machined or fabricated and substituted if desired.

What is claimed is:

1. A seating unit for a bathtub that is provided with a rear splash wall, said bathtub having a first side wall having an upper end, a second side wall having an upper end, a back end wall connecting the first side wall with the second side wall, said back end wall having an upper end, wherein the rear splash wall extends upwardly from the upper end of the back end wall of the bathtub, said seating unit comprising a panel member having first end, a second end, a first side surface extending between the first end and the second end, a second side surface extending between the first end and the second end opposite to the first side surface, a length sufficient to simultaneously contact the upper end of the first side wall and the upper end of the second side wall and a width sufficient to accommodate a sitting person, means for pivotally connecting the panel member to the rear splash wall at a location closely adjacent to the upper end of the back end wall so that the panel member will pivot from a storage position to a use position, wherein downward travel of the panel member is limited by the upper end of the first side wall of the bathtub, the upper end of the second side wall of the bathtub, and the upper end of the back end wall of the bathtub when the panel member is in the use position, wherein the panel member is positioned adjacent to the rear splash wall and is in contact with the upper end of the back end wall when the panel member is in the storage position, wherein the means for pivotally connecting the panel member to the rear splash wall comprises a first hinge pin notch in the first side surface of the panel member;

a second hinge pin notch in the first side surface of the panel member;

a first hinge pin portion positioned across the first hinge pin notch;

a second hinge pin portion positioned across the second hinge pin notch;

a first hinge member affixed to the rear splash wall, said hinge member having a hinge pin housing portion, wherein the hinge pin housing portion defines a hinge pin receiving borehole and a hinge pin receiving slot leading to said hinge pin receiving borehole, said first hinge pin portion being positioned in the hinge pin receiving borehole of the first hinge member; and a second hinge member affixed to the rear s plash wall, said hinge member having a hinge pin housing portion, wherein the hinge pin housing portion defines a hinge pin receiving borehole and a hinge pin receiving slot leading to the hinge pin receiving borehole, said second hinge pin portion being positioned in the hinge pin receiving borehole of the second hinge member, wherein the first hinge member further has a hinge member plate portion, wherein the hinge member plate portion has a first generally planar face and a second generally planar face opposite from the first generally planar face and extends from the first end surface of the hinge pin housing portion, and the hinge pin housing portion protrudes from the first generally planar face of the hinge member plate portion and extends at least partially across a width of the hinge member plate portion, the hinge member plate portion and the hinge pin housing portion forming a generally J shaped structure, and wherein the second hinge member further has a hinge member plate portion, wherein the hinge member plate portion has a first generally planar face and a second generally planar face opposite from the first generally planar face and extends from the first end surface of the hinge pin housing portion, and the hinge pin housing portion protrudes from the first generally planar face of the hinge member hinge member plate portion and extends at least partially across a width of the hinge member plate portion, the hinge member plate portion and the hinge pin housing portion forming a generally J shaped structure.

2. A seating unit as in claim 1 wherein the panel member further has a first generally planar panel face, an opposite second generally planar panel face, said panel member further defining an elongated slot extending from the first generally planar panel face to the second generally planar panel face, said elongated slot being positioned adjacent to the second side surface and being elongated in the direction of the length of the panel member.

3. A seating unit as in claim 2 wherein the panel member further defines a first end surface positioned at the first end of the panel member and a second end surface positioned at the second end of the panel member.

4. A seating unit as in claim 3 wherein a generally rounded edge connects the first generally planar panel face with the second side surface and a generally rounded edge connects the second generally planar panel face with the second side surface.

5. A panel member as in claim 3 wherein a generally rounded corner connects the first end surface with the first side surface, a generally rounded corner connects the first side surface with the second end surface, a generally rounded corner connects the first end surface with the second side surface, and a generally rounded corner connects the second side surface with the second end surface.

6. A seating unit as in claim 3 wherein a generally rounded edge connects the first generally planar panel face with the first end surface, a generally rounded edge connects the first generally planar panel face with the second end surface, a generally square edge connects the second generally planar panel face with the first end surface and a generally square edge connects the second generally planar panel face with the second end surface.

7. A seating unit as in claim 6 which is formed from a polymer shell encasing a lightweight core material.

8. A seating unit as in claim 6 which is formed from injection molded plastic.

9. A seating unit as in claim 3 wherein the first generally planar panel face and the second generally planar panel face each has a skid resistant surface.

10. A seating unit as in claim 1 wherein the panel member further has a first generally planar panel face and an opposite second generally planar panel face, wherein a generally rounded edge connects the first generally planar panel face with the first side surface and a generally rounded edge connects the second generally planar panel face with the first side surface.

11. A seating unit as in claim 1 further comprising a storage catch member affixed to the rear splash wall to releaseably retain the panel member in the storage position.

12. A seating unit as in claim 11 wherein the storage catch member releaseably engages a second side surface of the panel member.

13. A seating unit as in claim 12 wherein the storage catch member has an arm portion and a storage catch plate portion and is affixed to the rear splash wall by the storage catch plate portion, the arm portion extending away from the storage catch plate portion and having a generally concave lower surface to receive the second side surface of the panel member, at least the arm portion of the storage catch member being formed from a resilient material so that the arm portion is movable from a storage position to a use position to provide a latching function as the panel member moves into and out of the storage position.

14. A seating unit as in claim 13 wherein the second side surface of the panel member has a generally convex shape with a first radius and the generally concave lower surface of the arm portion of the storage catch member has a second radius which is larger than the first radius.

15. A seating unit as in claim 11 wherein the panel member is removable from the first hinge member and the second hinge member when the panel member is oriented in a panel unlock position, said panel unlock position being at a location between the storage position and the use position.

16. A seating unit as in claim 15 wherein the first hinge pin portion fits loosely in the hinge pin receiving borehole of the first hinge member, the second hinge pin portion fits loosely in the hinge pin receiving borehole of the second hinge member, the first hinge pin portion and the hinge pin receiving borehole of the first hinge pin member are coaxially positioned, and the second hinge pin portion and the hinge pin receiving borehole of the second hinge member are coaxially positioned, so that the first side surface of the panel member is supported by the upper end of the back end wall of the bathtub when the panel member is in the storage position.

17. A seating unit as in claim 16 wherein the first hinge member, the second hinge member, and the storage catch are adhesively affixed to the rear splash wall.

18. A seating unit as in claim 16 wherein each hinge pin housing portion has a first end, a second end, a first side surface, and a second side surface and the second end of the hinge pin housing portion forms a generally planar surface and is positioned at substantially a right angle to the first side surface and the second side surface of the hinge pin housing portion.

19. A seating unit as in claim 18 wherein the first end surface of each hinge pin housing portion defines a hinge pin receiving slot leading to the hinge pin receiving borehole, said hinge pin receiving slot extending across the width of the hinge pin housing portion from the first side surface to the second side surface, said hinge pin receiving slot having a width as measured between a hinge pin receiving slot inner surface and a hinge pin receiving slot outer surface which is less than a diameter of the hinge pin receiving borehole, said hinge pin housing portion further defining a taper leading from the hinge pin receiving borehole to the hinge pin receiving slot and a taper leading from the first end surface of the hinge pin housing portion to the hinge pin receiving slot.

20. A seating unit as in claim 19 wherein each hinge pin portion has a first generally planar face and a second generally planar face facing in the opposite direction from the first generally planar face, said first generally planar face and said second generally planar face being spaced apart a distance less than a distance as measured between the hinge pin receiving slot inner surface and the hinge pin receiving slot outer surface and being oriented so that the hinge pin portion can pass through the hinge pin receiving slot when the panel member is oriented in the panel unlock position.

21. A seating unit as in claim 20 wherein each hinge pin portion has a first generally cylindrical face and a second generally cylindrical face facing in the opposite direction from the first generally cylindrical face, said first generally cylindrical face and said second generally cylindrical face being spaced apart a distance greater than the distance as measured between the hinge pin receiving slot inner surface and the hinge pin receiving slot outer surface and being oriented so that the hinge pin portion is retained in the hinge pin receiving borehole when the panel member is oriented in any position other than in the panel unlock position.

22. A seating unit as in claim 19 wherein each hinge pin receiving slot is oriented generally radially with respect to the hinge pin receiving borehole.

23. A seating unit as in claim 22 wherein each hinge pin receiving slot is oriented at an angle in the range of from about 3 degrees to about 30 degrees with respect to the second generally planar face of the hinge member plate portion.

24. A seating unit as in claim 22 wherein each hinge pin receiving slot is oriented at an angle in the range of from about 5 degrees to about 10 degrees with respect to the second generally planar face of the hinge member plate portion.

* * * * *